US008607866B2

(12) United States Patent
Fang et al.

(10) Patent No.: US 8,607,866 B2
(45) Date of Patent: Dec. 17, 2013

(54) METHOD FOR ACCELERATING START-UP FOR STEAM ASSISTED GRAVITY DRAINAGE OPERATIONS

(75) Inventors: Windsong Fang, Houston, TX (US); Thomas J. Wheeler, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 479 days.

(21) Appl. No.: 12/716,939

(22) Filed: Mar. 3, 2010

(65) Prior Publication Data

US 2010/0243249 A1 Sep. 30, 2010

Related U.S. Application Data

(60) Provisional application No. 61/163,327, filed on Mar. 25, 2009.

(51) Int. Cl.
*E21B 43/24* (2006.01)

(52) U.S. Cl.
USPC ..... 166/272.3

(58) Field of Classification Search
USPC ..... 166/272.3, 272.7
See application file for complete search history.

(56) References Cited

U.S. PATENT DOCUMENTS

| | | | | |
|---|---|---|---|---|
| 4,116,275 | A * | 9/1978 | Butler et al. | 166/303 |
| 4,344,485 | A | 8/1982 | Butler | |
| 5,046,559 | A * | 9/1991 | Glandt | 166/248 |
| 5,215,146 | A * | 6/1993 | Sanchez | 166/272.3 |
| 5,407,009 | A | 4/1995 | Butler et al. | |
| 5,931,230 | A * | 8/1999 | Lesage et al. | 166/303 |
| 6,257,334 | B1 * | 7/2001 | Cyr et al. | 166/272.7 |
| 7,975,763 | B2 * | 7/2011 | Banerjee et al. | 166/248 |
| 2003/0141053 | A1 * | 7/2003 | Yuan et al. | 166/248 |
| 2006/0042794 | A1 * | 3/2006 | Pfefferle | 166/272.7 |
| 2006/0162922 | A1 * | 7/2006 | Chung et al. | 166/245 |
| 2007/0102152 | A1 * | 5/2007 | Forgeron | 166/249 |
| 2007/0181299 | A1 * | 8/2007 | Chung et al. | 166/245 |

FOREIGN PATENT DOCUMENTS

| | | |
|---|---|---|
| CA | 1304287 | 6/1989 |
| WO | WO9967503 | 12/1999 |

* cited by examiner

*Primary Examiner* — Angela M DiTrani
*Assistant Examiner* — Silvana Runyan
(74) *Attorney, Agent, or Firm* — ConocoPhillips Company

(57) ABSTRACT

The present embodiment is a method for decreasing the time required for a start-up phase in a steam assisted gravity drainage production. The present method begins by forming a steam assisted gravity drainage production well pair within a formation comprising an injection well and a production well, beginning a preheating stop by introducing heat between the injection well and the production well, beginning a steam squeeze stage by injection steam into the formation and beginning the steam assisted gravity drainage production.

8 Claims, 4 Drawing Sheets

METHOD FOR ACCELERATING START-UP FOR STEAM ASSISTED GRAVITY DRAINAGE OPERATIONS

CROSS-REFERENCE TO RELATED APPLICATIONS

None

STATEMENT REGARDING FEDERALLY SPONSORED RESEARCH OR DEVELOPMENT

None

FIELD OF THE INVENTION

A method for accelerating the start-up phase for a steam assisted gravity drainage operations.

BACKGROUND OF THE INVENTION

A variety of processes are used to recover viscous hydrocarbons, such as heavy oils and bitumen, from underground deposits. There are extensive deposits of viscous hydrocarbons around the world, including large deposits in the Northern Alberta tar sands, that are not amenable to standard oil well production technologies. The primary problem associated with producing hydrocarbons from such deposits is that the hydrocarbons are too viscous to flow at commercially relevant rates at the temperatures and pressures present in the reservoir. In some cases, such deposits are mined using open-pit mining techniques to extract the hydrocarbon-bearing material for later processing to extract the hydrocarbons.

Alternatively, thermal techniques may be used to heat the reservoir to produce the heated, mobilized hydrocarbons from wells. One such technique for utilizing a single horizontal well for injecting heated fluids and producing hydrocarbons is described in U.S. Pat. No. 4,116,275, which also describes some of the problems associated with the production of mobilized viscous hydrocarbons from horizontal wells.

One thermal method of recovering viscous hydrocarbons using two vertically spaced horizontal wells is known as steam-assisted gravity drainage (SAGD). SAGD is currently the only commercial process that allows for the extraction of bitumen at depths too deep to be strip-mined. By current estimates the amount of bitumen that is available to be extracted via SAGD constitutes approximately 80% of the 1.3 trillion barrels of bitumen in place in the Athabasca oilsands in Alberta, Canada. Various embodiments of the SAGD process are described in Canadian Patent No. 1,304,287 and corresponding U.S. Pat. No. 4,344,485. In the SAGD process, steam is pumped through an upper, horizontal, injection well into a viscous hydrocarbon reservoir while hydrocarbons are produced from a lower, parallel, horizontal, production well vertically spaced proximate to the injection well. The injector and production wells are typically located close to the bottom of the hydrocarbon deposit.

It is believed that the SAGD process works as follows. The injected steam creates a 'steam chamber' in the reservoir around and above the horizontal injection well. As the steam chamber expands upwardly and laterally from the injection well, viscous hydrocarbons in the reservoir are heated and mobilized, especially at the margins of the steam chamber where the steam condenses and heats a layer of viscous hydrocarbons by thermal conduction. The mobilized hydrocarbons (and aqueous condensate) drain under the effects of gravity towards the bottom of the steam chamber, where the production well is located. The mobilized hydrocarbons are collected and produced from the production well. The rate of steam injection and the rate of hydrocarbon production may be modulated to control the growth of the steam chamber to ensure that the production well remains located at the bottom of the steam chamber in an appropriate position to collect mobilized hydrocarbons. Typically the start-up phase takes three months or more before communication is established, depending on the formation lithology and actual interwell spacing. There exists a need for a way to shorten the preheating period without sacrificing SAGD production performance.

It is important for efficient production in the SAGD process that conditions in the portion of the reservoir spanning the injection well and the production well are maintained so that steam does not simply circulate between the injector and the production wells, short-circuiting the intended SAGD process. This may be achieved by either limiting steam injection rates or by throttling the production well at the wellhead so that the bottomhole temperature at the production well is below the temperature at which steam forms at the bottomhole pressure. While this is advantageous for improving heat transfer, it is not an absolute necessity, since some hydrocarbon production may be achieved even where steam is produced from the production well.

A crucial phase of the SAGD process is the initiation of a steam chamber in the hydrocarbon formation. The typical approach to initiating the SAGD process is to simultaneously operate the injector and production wells independently of one another to recirculate steam. The injector and production wells are each completed with a screened (porous) casing (or liner) and an internal tubing string extending to the end of the liner, forming an annulus between the tubing and the casing. High pressure steam is simultaneously injected through the tubings of both the injection well and the production well. Fluid is simultaneously produced from each of the production and injection wells through the annulus between the tubing string and the casing. In effect, heated fluid is independently circulated in each of the injection and production wells during this start-up phase, heating the hydrocarbon formation around each well by thermal conduction. Independent circulation of the wells is continued until efficient fluid communication between the wells is established. In this way, an increase in the fluid transmissibility through the inter-well span between the injection and production wells is established by conductive heating. Once efficient fluid communication is established between the injection and the production wells, the injection well is dedicated to steam injection and the production well is dedicated to fluid production. Canadian Patent No. 1,304,287 teaches that in the SAGD start-up process, while the production and injection wells are being operated independently to inject steam, steam must be injected through the tubing and fluid collected through the annulus, not the other way around. It is disclosed that if steam is injected through the annulus and fluid collected through the tubing, there is excessive heat loss from the annulus to the tubing and its contents, whereby steam entering the annulus loses heat to both the formation and to the tubing, causing the injected steam to condense before reaching the end of the well.

The requirement for injecting steam through the tubing of the wells in the SAGD start-up phase can give rise to a problem. The injected steam must travel to the toe of the well, and then migrate back along the well bore to heat the length of the horizontal well. At some point along the length of the well bore, a fracture or other disconformity in the reservoir may be encountered that will absorb a disproportionately large amount of the injected steam, interfering with propagation of the conductive heating front back along the length of the well bore.

U.S. Pat. No. 5,407,009 identifies a number of potential problems associated with the use of the SAGD process in hydrocarbon formations that are underlain by aquifers. The U.S. Pat. No. 5,407,009 teaches that thermal methods of heavy hydrocarbon recovery such as SAGD may be inefficient and uneconomical in the presence of bottom water (a zone of mobile water) because injected fluids (and heat) are lost to the bottom water zone ("steam scavenging"), resulting in low hydrocarbon recoveries. U.S. Pat. No. 5,407,009 also addresses this problem using a technique of injecting a hydrocarbon solvent vapour, such as ethane, propane or butane, to mobilize hydrocarbons in the reservoir.

There have been efforts to promote methods that reduce the start-up time in SAGD production such as U.S. Pat. No. 5,215,146. U.S. Pat. No. 5,215,146 describes a method for reducing the start-up time in SAGD operation by maintaining a pressure gradient between upper and lower horizontal wells with foam. By maintaining this pressure gradient hot fluids are forced from the upper well into the lower well. However, there exists an added cost and maintenance requirement due to the need to create foam downhole, an aspect that is typically not required in SAGD operation.

Other methods, initiate the recovery of viscous hydrocarbons from underground deposits by injecting heated fluid into the hydrocarbon deposit through an injection well while withdrawing fluids from a production well. when such a method is utilize the flow of heated fluid between the injection well and the production well raises the temperature of the reservoir between the wells to establish appropriate conditions for recovery of hydrocarbons. However, there exists an added cost and maintenance requirement due to the need to injected heated fluid downhole, an aspect that is not required in typical SAGD operation There exists a need for a method to reduce the start-up time in a SAGD operation that does not require foam or the need for injecting fluids downhole.

SUMMARY OF THE INVENTION

The present embodiment discloses a method for decreasing the time required for a start-up phase in a steam assisted gravity drainage production. The present method describes forming a steam assisted gravity drainage production well pair within a formation comprising an injection well and a production well, beginning a preheating stop by introducing heat between the injection well and the production well, beginning a steam squeeze stage by injection steam into the formation and beginning the steam assisted gravity drainage production.

BRIEF DESCRIPTION OF THE DRAWINGS

The invention, together with advantages thereof, may best be understood by reference to the following description taken in conjunction with the accompanying drawings.

DETAILED DESCRIPTION OF THE INVENTION

Figure 1A:
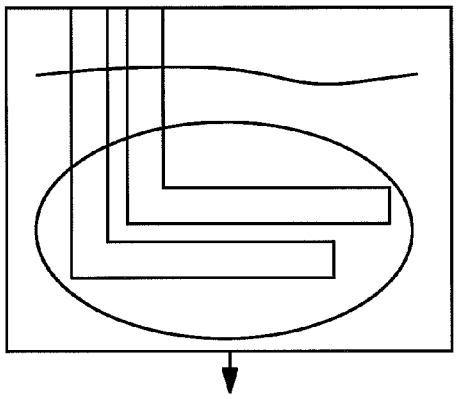
FIG. 1 depicts an embodiment of the start-up phase method.
Figure 1B:
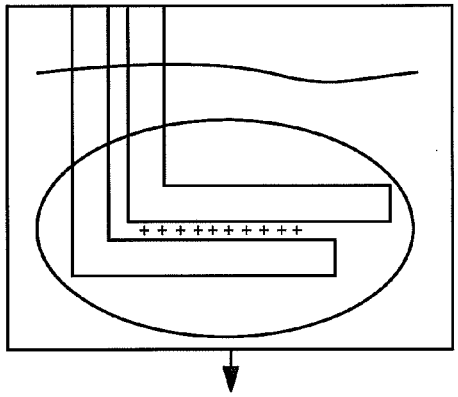
Figure 1C:
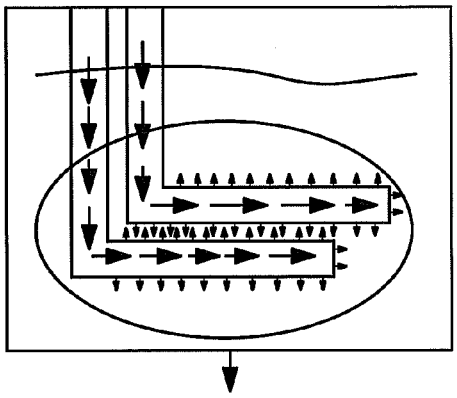
Figure 1D:
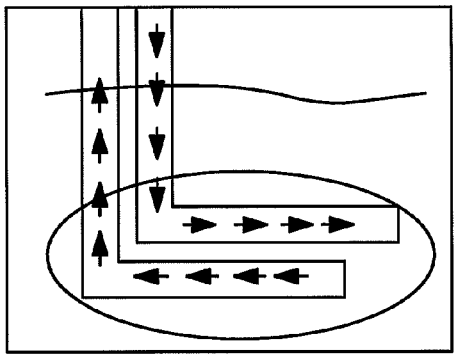
Figure 2A:
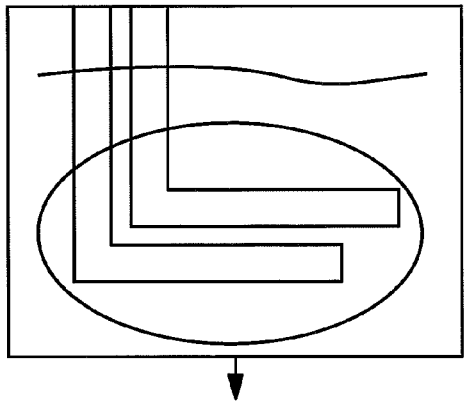
FIG. 2 depicts an alternate embodiment of the start-up phase method.
Figure 2B:
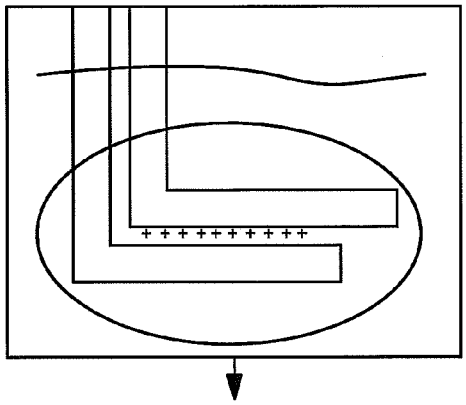
Figure 2C:
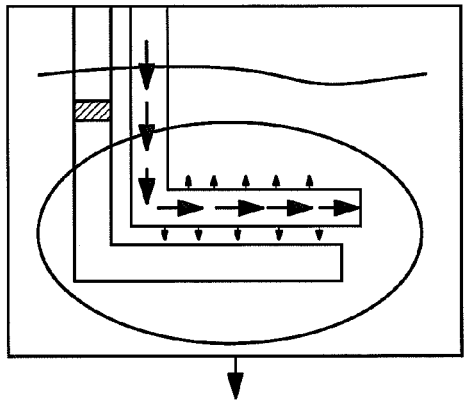
Figure 2D:
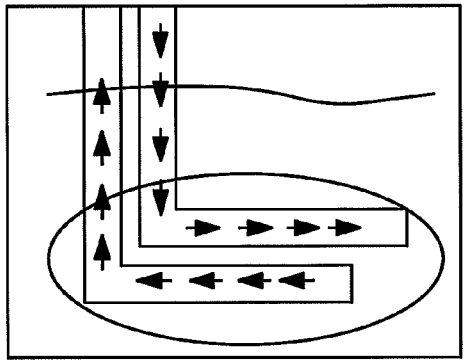
Figure 3A:
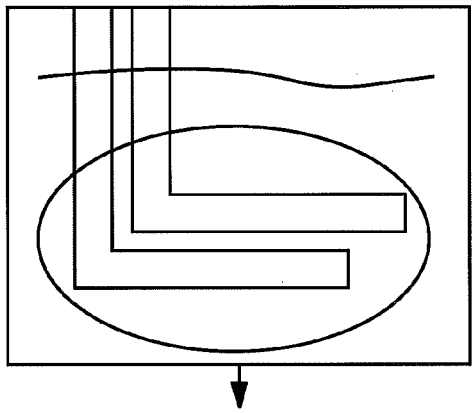
FIG. 3 depicts yet another embodiment of the start-up phase method.
Figure 3B:
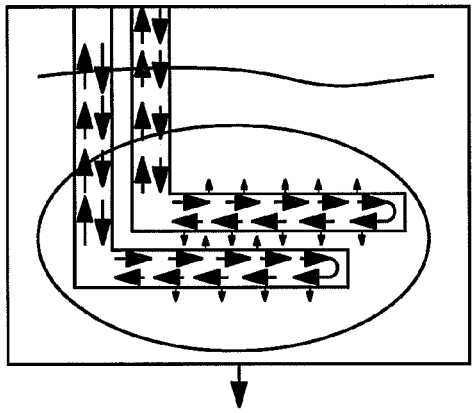
Figure 3C:
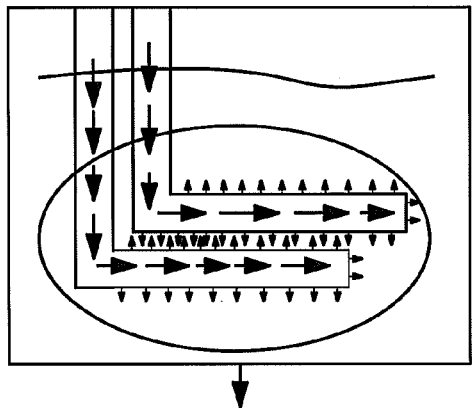
Figure 3D:
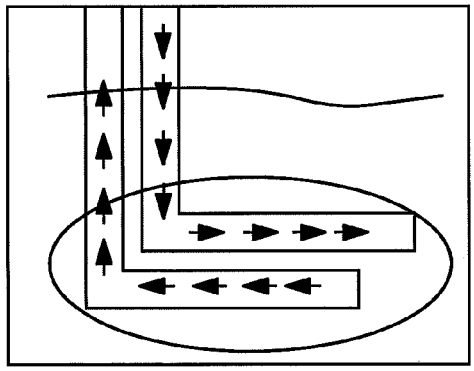

The present embodiment depicts a method for decreasing the time required for the start-up phase in a steam assisted gravity drainage production. The method begins by forming a steam assisted gravity drainage production well pair within a formation comprising an injection well and a production well. Subsequently, a preheating stage is begun by introducing heat beteen the injection well and the production well. This is followed by a steam squeeze stage by injecting steam into the formation. After this initial start phase, production utilizing steam assisted gravity drainage begins.

In this embodiment the injection well and the production well are not meant to limit the wells to only injection or production instead are merely used as descriptors of the type of wells the wells can become. Therefore it is possible for the injection well to be used for production and accordingly the production well to be used for injection. Additionally, the descriptors of the injection well and the production well are not meant to limit the placement of the wells, therefore it is feasible that the production well is above the injection well or the injection well be above the production well.

The present embodiment is able to decrease the period of time typically required for the start-up phase in a conventional SAGD production. The goal of a typical start-up phase in a SAGD production is to promote communication between the injection well and production well for the eventual flow of hydrocarbons into the production well. Typical start-up phases require three months or longer before adequate communication are established to induce hydrocarbon flow. The present embodiment is able to reduce the start-up time frame 20%, 30%, 40%, 50%, 60% or even 70% from what is typically required. In a preferred example it can be shown that the present embodiment can reduce the start-up time by 66%.

The preheating stage of introducing heat into the formation can occur via any method currently known in the art. Typical methods include: electric, electromagnetic, microwave, radio frequency heating and steam circulation. In a preferred embodiment the heating of the formation occurs via steam circulation. In one method the heating stage occurs predominately from conductive heating.

The steam squeeze stage of the invention is performed by injecting steam into the formation. When steam is injected into the formation, the amount of steam that is injected into the formation occurs at a rate greater than which a substantial amount can be reproduced out of the wells. Reducing the amount of steam that can be reproduced out of the wells causes the steam to penetrate the formation and heat the hydrocarboneous surroundings. The continuous flow of steam into the formation stops after a sufficient period of time necessary to promote communication between the wells via convective heat transfer in the formation. Using the present method the time period required to establish communication between the wells can range from around 1-7 days, 3-7 days, 5-7 days, 1-5 days, 3-5 days, 1-3 days or even 1 day. Typically the range of time varies from 1 to 7 days. The present embodiment is able to stop 50%, 60%, 70%, 80%, 85%, 90%, 95%, 98%, 99% even 100% of the reproduction out of the wells.

Different methods that can be employed to prevent a substantial amount of steam from being reproduced out of the wells include: injecting steam into both the injection well and the production well simultaneously thereby preventing reproduction of steam out of the well or shutting down one of the wells. Any method commonly known in the art can be used to shut down the well. Some commonly known methods include shutting down the well with a valve.

FIG. 1 depicts a non-limiting embodiment of the start-up phase of the current method. The method begins with forming a steam assisted gravity drainage production well pair comprising an injection well and a production well as shown in FIG. 1 as stage 1A.

The preheating stage is shown in FIG. 1 as stage 1B. In the preheating stage heat is introduced between the injection well and the production well. Heat is depicted in this stage with the "+" symbol. During this preheating period various methods of heating the formation include those typically known in the art, and more particularly those mentioned above can be utilized.

The steam squeeze stage of injecting steam into the formation is shown in FIG. 1 as stage 1C. One embodiment of the steam squeeze stage is shown in this figure, depicting the injection of steam into both wells. The goal of this stage is to introduce convective heating in the formation with the flow of the injected steam. It is theorized that the key to achieving this goal is injecting the steam into the stratum at a rate greater than which a substantial amount of steam can be reproduced out of the wells.

The final stage of beginning the steam assisted gravity drainage production is shown in FIG. 1 as stage 1D. In this stage a typical SAGD production occurs with the injection of steam down the injection well and the production of hydrocarbons with the production well. One of the benefits of the present method is the accelerated time frame in which this stage 1D can occur without any decrease in the quality and quantity of production from the well.

FIG. 2 depicts an alternate non-limiting embodiment of the start-up phase of the current method. In this alternate embodiment the injection of steam is not injected through both wells, but instead only through one. The method begins with forming a steam assisted gravity drainage production well pair comprising an injection well and a production well as shown in FIG. 2 as stage 2A.

In this alternate embodiment, the preheating stage as shown in FIG. 2 stage 2B. In the preheating stage heat is introduced between the injection well and the production well. Heat is depicted in this stage with the "+" symbol. During this preheating period various methods of heating the formation include those typically known in the art, and more particularly those mentioned above can be utilized.

The steam squeeze stage of injecting steam into the formation is shown in FIG. 2 as stage 2C. In this embodiment it is shown that the injection of steam only occurs though one well while the other well is shut down. In this non-limiting depiction the shut down portion is depicted in the vertical portion of the well, although it could be anywhere along the well. Additionally the shutdown of the well can be by any means commonly known in the art. The goal of this stage is to introduce convective heating in the formation with the flow of the injected steam. It is theorized that the key to achieving this goal is injecting the steam into the stratum at a rate greater than which a substantial amount of steam can be reproduced out of the wells.

The final stage of beginning steam assisted gravity drainage is shown in FIG. 2 as stage 2D. In this stage a typical SAGD production occurs with the injection of steam down the injection well and the producing of hydrocarbons with the producing well. One of the benefits of the present method is the accelerated time frame in which this stage 2D can occur without any decrease in the quality and quantity of production from the well.

FIG. 3 depicts a non-limiting embodiment of the start-up phase of the current method. The method begins with forming a steam assisted gravity drainage production well pair comprising an injection well and a production well as shown in FIG. 3 as stage 3A.

In this alternate embodiment, the preheating stage as shown in FIG. 3 stage 3B. Steam is shown circulating within the well pair. As the steam is injected and circulated within the well pair conductive heating of the formation occurs.

The steam squeeze stage of injecting of steam into the formation is shown in FIG. 3 as stage 3C. One embodiment of the steam squeeze stage is shown in this figure, depicting the injection of steam into both wells. The goal of this stage is to introduce convective heating in the formation with the flow of the injected steam. It is theorized that the key to achieving this goal is injecting the steam into the stratum at a rate greater than which a substantial amount of steam can be reproduced out of the wells.

The final stage of beginning the steam assisted gravity drainage production is shown in FIG. 3 as stage 3D. In this stage a typical SAGD production occurs with the injection of steam down the injection well and the production of hydrocarbons with the production well. One of the benefits of the present method is the accelerated time frame in which this stage 3D can occur without any decrease in the quality and quantity of production from the well.

Figure 4:
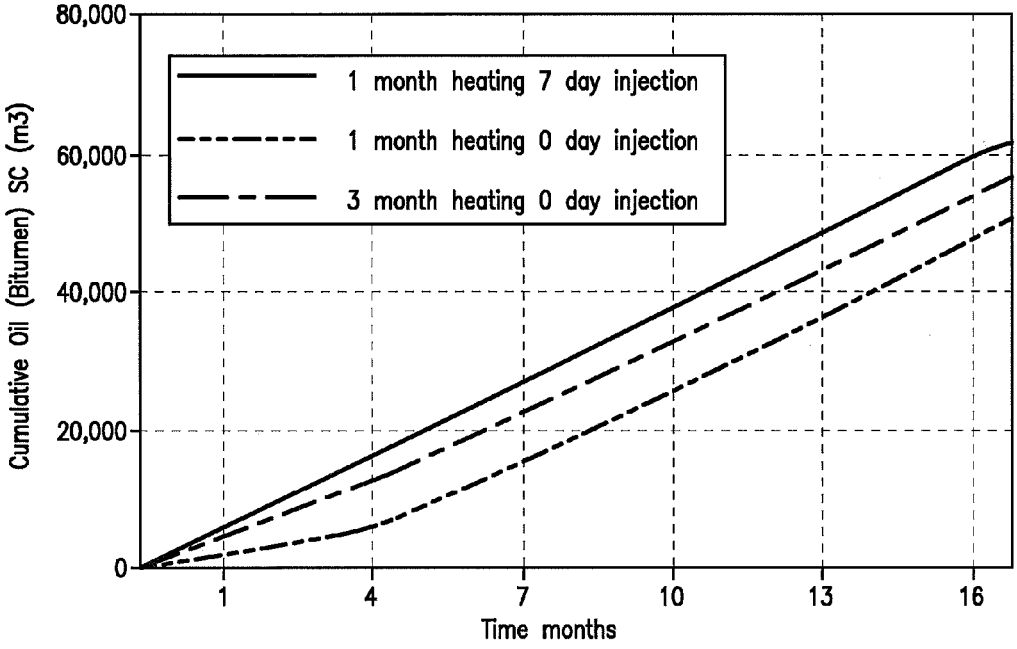
FIG. 4 depicts a graphical representation comparing the current method to previous start-up phase methods

FIG. 4 depicts a graphical representation of that a shortened start-up phase in a SAGD operation compared to a one-month start-up phase and a three-month start-up phase. In this graph "1 month heating 7 day injection" refers to 1 month of heating the formation followed by 7 days of injecting steam into the formation at a greater quantity than the steam being reversed flowed out of the wells. "1 month heating 0 day injection" refers to 1 month of heating the formation followed by 0 days of injecting the steam into the formation at a greater quantity than the steam being reversed flowed out of the wells. "3 month heating 0 day injection" refers to the typical SAGD start-up phase wherein the formation is heated but there does not involve the stage wherein a substantial amount of steam entering the formation does is greater than the stream being flowed back out of the wells.

From this graph it is shown that cumulative oil bitumen obtained through the resultant SAGD production is improved with the current method, which involves the injection phase. Although the "1 month heating 0 day injection" does eventually obtain a steady production of oil out of the formation the initial period before the well starts producing is hampered by not having the current methods injection stage.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method comprising the sequential steps of:

a) forming a steam assisted gravity drainage production well pair within a formation and comprising an injection well and a production well;

b) beginning a preheating stage by introducing heat between the injection well and the production well and including at least one of three methods selected from microwave, radio frequency heating and steam circulation in which fluid is produced simultaneously and continuously during steam injection and in a same one of the wells used for the injection such that the circulation is independent between the injection and production wells;

c) beginning a steam squeeze stage by injecting steam into the formation via at least one of the injection well and the production well at a rate greater than which the steam is reproduced out of the injection well and the production well, wherein the steam that does not reproduce out of the injection well and the production well is greater than 50%; and d) beginning steam assisted gravity drainage production that is started with the well pair and is thereby each initial use of the injection well and the production well in a steam assisted gravity drainage process.

2. The method of claim 1, wherein the preheating stage is performed by circulating steam.

3. The method of claim 1, wherein the preheating stage into the formation occurs predominately via conductive heating.

4. The method of claim 1, wherein the steam squeeze stage is accomplished by injecting steam into one of the wells while shutting down the other well.

5. The method of claim 1, wherein the steam that does not reproduce out of the injection well and the production well is greater than 95%.

6. The method of claim 1, wherein the period of time sufficient to promote the communication between the injection well and the production well ranges from 1 to 7 days.

7. The method of claim 1, wherein the preheating stage includes the steam circulation in both the injection and the production wells.

8. The method of claim 1, wherein the steam squeeze stage includes injecting the steam in both the injection and the production wells.

* * * * *